US007229181B2

(12) United States Patent
Diak/Ghanem

(10) Patent No.: US 7,229,181 B2
(45) Date of Patent: Jun. 12, 2007

(54) INSULATED BEVERAGE CUP

(75) Inventor: Darlene Diak/Ghanem, Deerfield Beach, FL (US)

(73) Assignee: Worry Free Inventions, Inc., Deerfield Beach, FL (US)

( * ) Notice: Subject to any disclaimer, the term of this patent is extended or adjusted under 35 U.S.C. 154(b) by 101 days.

(21) Appl. No.: 10/958,811

(22) Filed: Oct. 4, 2004

(65) Prior Publication Data

US 2005/0045643 A1 Mar. 3, 2005

Related U.S. Application Data

(63) Continuation of application No. 10/000,826, filed on Oct. 24, 2001, now abandoned.

(51) Int. Cl.
*F21V 33/00* (2006.01)

(52) U.S. Cl. ..... 362/101; 362/84; 362/806; 215/11.1; 220/717; 250/462.1

(58) Field of Classification Search ..... 362/84, 362/101, 806, 812; 220/713, 717; 215/11.1; 250/462.1

See application file for complete search history.

(56) References Cited

U.S. PATENT DOCUMENTS

| | | | | |
|---|---|---|---|---|
| 4,759,453 | A * | 7/1988 | Paetzold | 215/11.1 |
| 5,456,380 | A * | 10/1995 | Ito et al. | 220/713 |
| 6,213,616 | B1 * | 4/2001 | Chien | 362/84 |
| 6,269,968 | B1 * | 8/2001 | Belcastro | 220/717 |
| 6,631,819 | B1 * | 10/2003 | Diak/Ghanem | 215/11.1 |
| 6,921,179 | B2 * | 7/2005 | Diak Ghanem | 362/84 |
| 2002/0141175 | A1 * | 10/2002 | Suby | 362/84 |

* cited by examiner

*Primary Examiner*—Stephen F Husar
(74) *Attorney, Agent, or Firm*—Robert M. Downey, P.A.

(57) ABSTRACT

An insulated drinking vessel includes an inner wall surrounding an interior for containing a liquid beverage and a transparent outer wall spaced from the inner wall to form an air space which acts to insulate the vessel interior in order to maintain the temperature of the liquid beverage contents within a desired range throughout a period of time which is normally required to consume the entire beverage contents. A removable top lid for covering the open top of the vessel includes an integrated sip spout extending upwardly from the lid. In one preferred embodiment, the drinking vessel and lid are in the form of a child's sip cup. The drinking vessel may further be provided with light-absorbing luminescent material to enhance the appearance and visibility of the drinking vessel as well as the level of the liquid contents when in a dark or dim light environment.

6 Claims, 4 Drawing Sheets

INSULATED BEVERAGE CUP

This Application is a continuation application of patent application Ser. No. 10/000,826 filed on Oct. 24, 2001, now abandoned.

BACKGROUND OF THE INVENTION

1. Field of the Invention

This invention relates to an insulated drinking vessel and, more particularly, to a drinking vessel having a double wall insulated construction and a removable top lid with an integrated sip spout extending upwardly therefrom.

2. Discussion of the Related Art

Insulated drinking vessels are well known in the art. Moreover, drinking vessels having a double wall structure with an insulating void between the walls are well known. Notwithstanding, there remains a longstanding and unfilled need for an insulated drinking vessel having an inner wall, an outer wall spaced from the inner wall to form an insulating void between the walls, and a removable top lid having an integrated sip spout extending upwardly therefrom, thereby providing a spill proof drinking vessel which maintains the temperature of the liquid beverage contents within a desired range for an extended period of time. In particular, there remains an urgent need for a child's sip cup having a double wall insulating structure with a removable top lid having an integrated sip spout extending upwardly from the lid. There is a further need for an insulated drinking vessel with light absorbing luminescent material for enhancing the appearance and visibility of the drinking vessel, as well as the level of the liquid contents, when in dark and dim light conditions.

SUMMARY OF THE INVENTION

The present invention is directed to an insulated drinking vessel which includes an inner wall surrounding an interior for containing a liquid beverage and a transparent outer wall spaced from the inner wall to form a space or void which acts to insulate the vessel interior in order to maintain the temperature of the liquid beverage contents within a desired range throughout a period of time required to consume the beverage contents. A removable top lid is provided for covering the open top of the vessel. The top lid includes an integrated sip spout extending upwardly therefrom which allows the beverage contents to be consumed while the lid remains attached to the vessel. The lid further serves to prevent accidental spill of the beverage contents. In one embodiment, a light absorbing luminescent material is applied to the insulating double wall structure of the vessel to enhance the appearance and visibility of the drinking vessel, as well as the liquid contents therein, when in a dark or dim light environment. The luminescent material may be applied to the exterior surface of the inner wall so that the luminescent material is encapsulated by the inner and outer walls. This serves to prevent exposure of the luminescent material to the beverage contents and the user, while also preventing removal of the luminescent material due to contact (e.g. scratching) or exposure to harsh conditions, such as in a dishwasher.

OBJECTS AND ADVANTAGES OF THE INVENTION

It is a principal object of the present invention to provide an insulated drinking vessel for beverages, wherein the vessel is provided with a double wall construction and a removable top lid having an integrated sip spout.

It is a further object of the present invention to provide an insulated drinking vessel in the form of a child's sip cup wherein the drinking vessel includes an insulating double wall construction and a removable top lid with an integrated sip spout and valve for resisting spills.

It is still a further object of the present invention to provide an insulated drinking vessel having an inner wall and an outer wall spaced from the inner wall to provide an insulating void therebetween, and further wherein the insulated drinking vessel includes luminescent features to enhance the visibility of the drinking vessel in dark and dim light environments.

It is still a further object of the present invention to provide an insulated drinking vessel which glows in the dark to enable the user to determine the amount of liquid beverage contents remaining in the drinking vessel when in dark or dim light conditions.

These and other objects and advantages of the present invention are more readily apparent with reference to the following detailed description taken in conjunction with the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

The insulated drinking vessel of the present invention is shown throughout the drawings according to various embodiments thereof, wherein the drinking vessel is generally indicated as 10.

Figure 1:
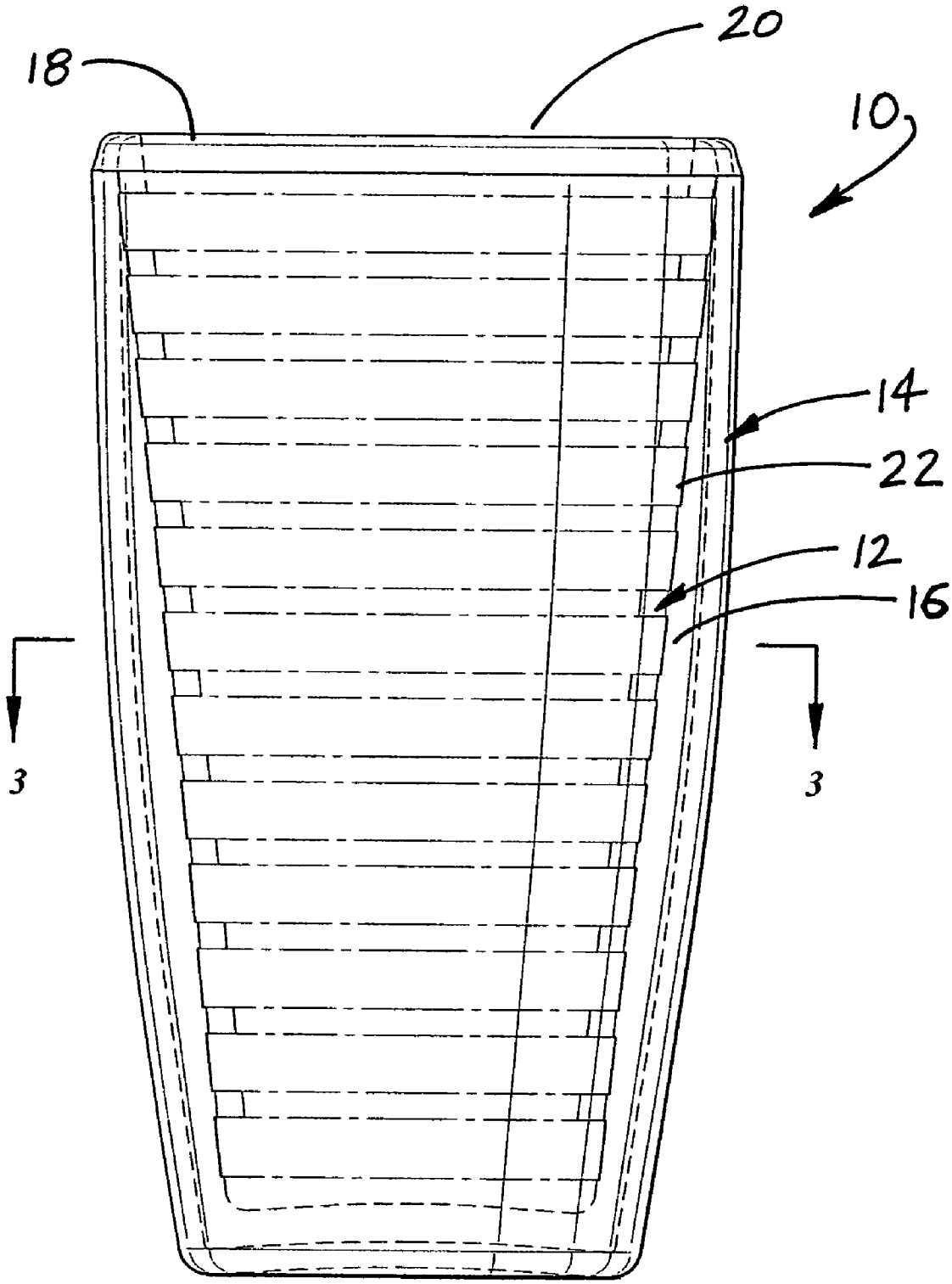
FIG. 1 is a elevational view of the insulated drinking vessel of the present invention, in accordance with one embodiment thereof.
Figure 2:
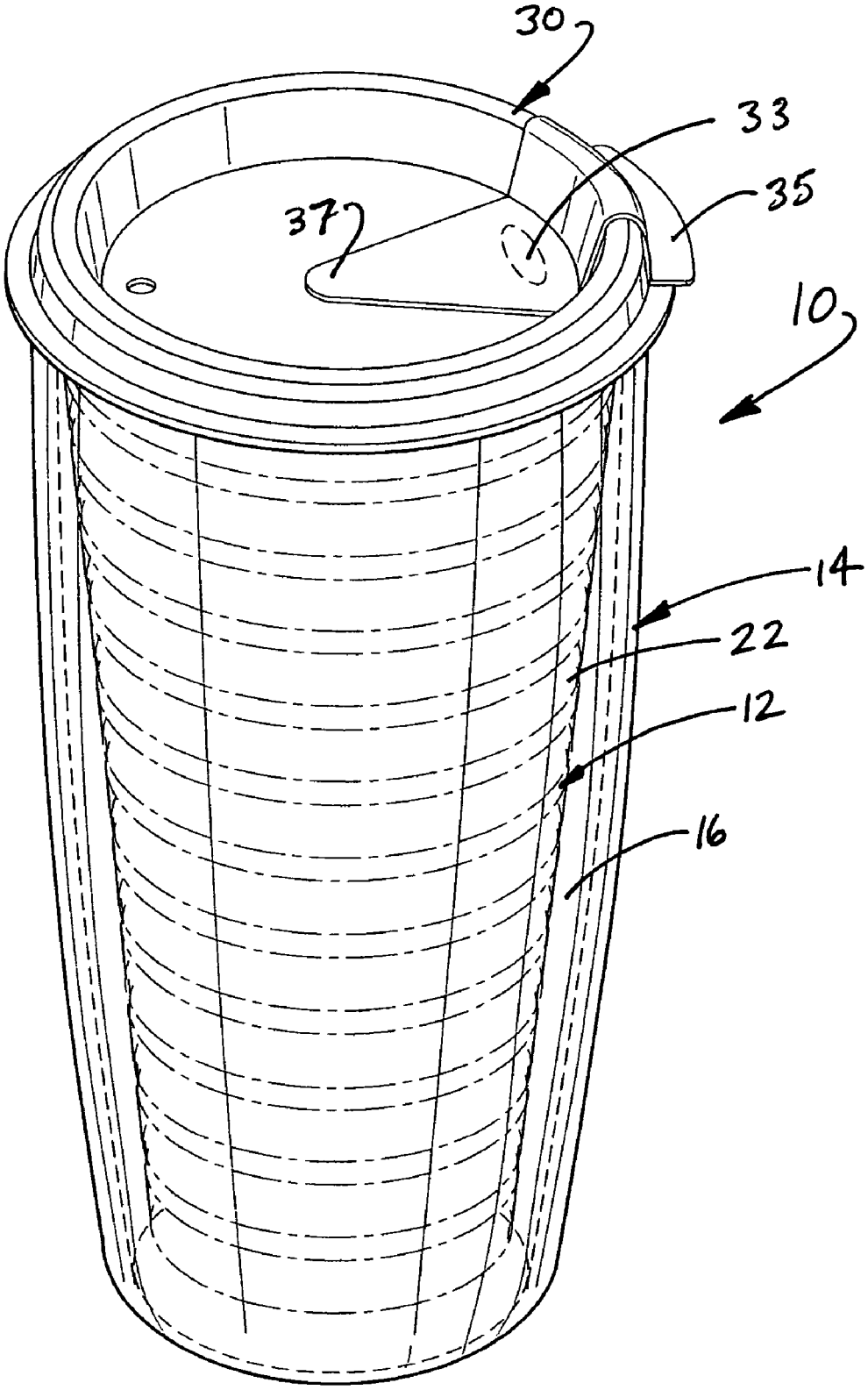
FIG. 2 is a top perspective view of the insulated drinking vessel of the present invention, shown with a removable lid attached thereto.
Figure 3:
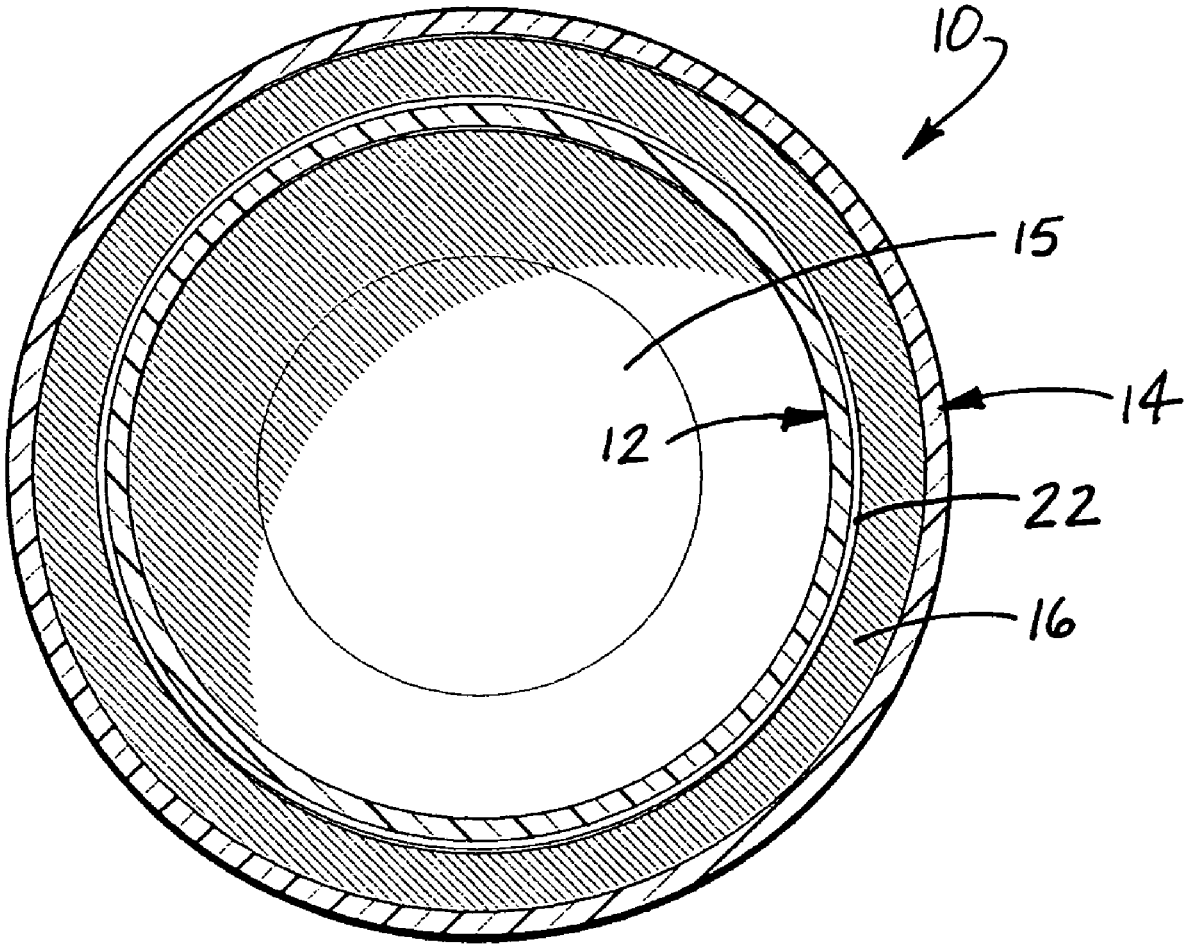
FIG. 3 is a top plan view, in cross-section, taken along the plane of the line indicated by the arrows 3—3 in FIG. 1.

FIGS. 1–3 illustrate one embodiment of the drinking vessel 10. In this particular embodiment, the drinking vessel 10 is in the form of a tumbler or highball drinking glass. The drinking vessel 10 is provided with an insulated wall structure including an inner wall 12 and an outer wall 14. The inner wall 12 surrounds an interior 15 of the drinking vessel which is structured and disposed to contain a liquid beverage therein. The outer wall 14 is spaced from the inner wall to provide a gap or void 16 between the inner and outer walls. The inner wall and outer wall are joined at an upper end to form a rim 18 surrounding an open top 20 communicating with the vessel interior 15. In a preferred embodiment, both the inner wall 12 and outer wall 14 are formed of a transparent material.

Referring to the embodiment of FIGS. 1–3, a removable top lid 30 is provided for covering the open top 20 of the drinking vessel 10. The top lid 30 includes a valve for closing an opening in the lid, thereby preventing inadvertent spills. Specifically, a sliding guard 35 pivots at its center 37 to move over an opening 33 in the lid 30, thereby blocking the opening 33 so that the liquid beverage contents within the vessel 10 are unable to exit the opening 33 in the event the drinking vessel is turned on its side or inverted.

In at least one embodiment, the inner wall 12 is provided with a light-absorbing luminescent material 22 which glows in the dark and is visible through the outer transparent wall 14. The luminescent material enhances the appearance of the drinking vessel 10 and allows the user to see the drinking vessel when in dark or dim light conditions. The luminescent material further allows the user to view the level of the liquid contents in the drinking vessel when in a dim light or dark environment.

Figure 4:
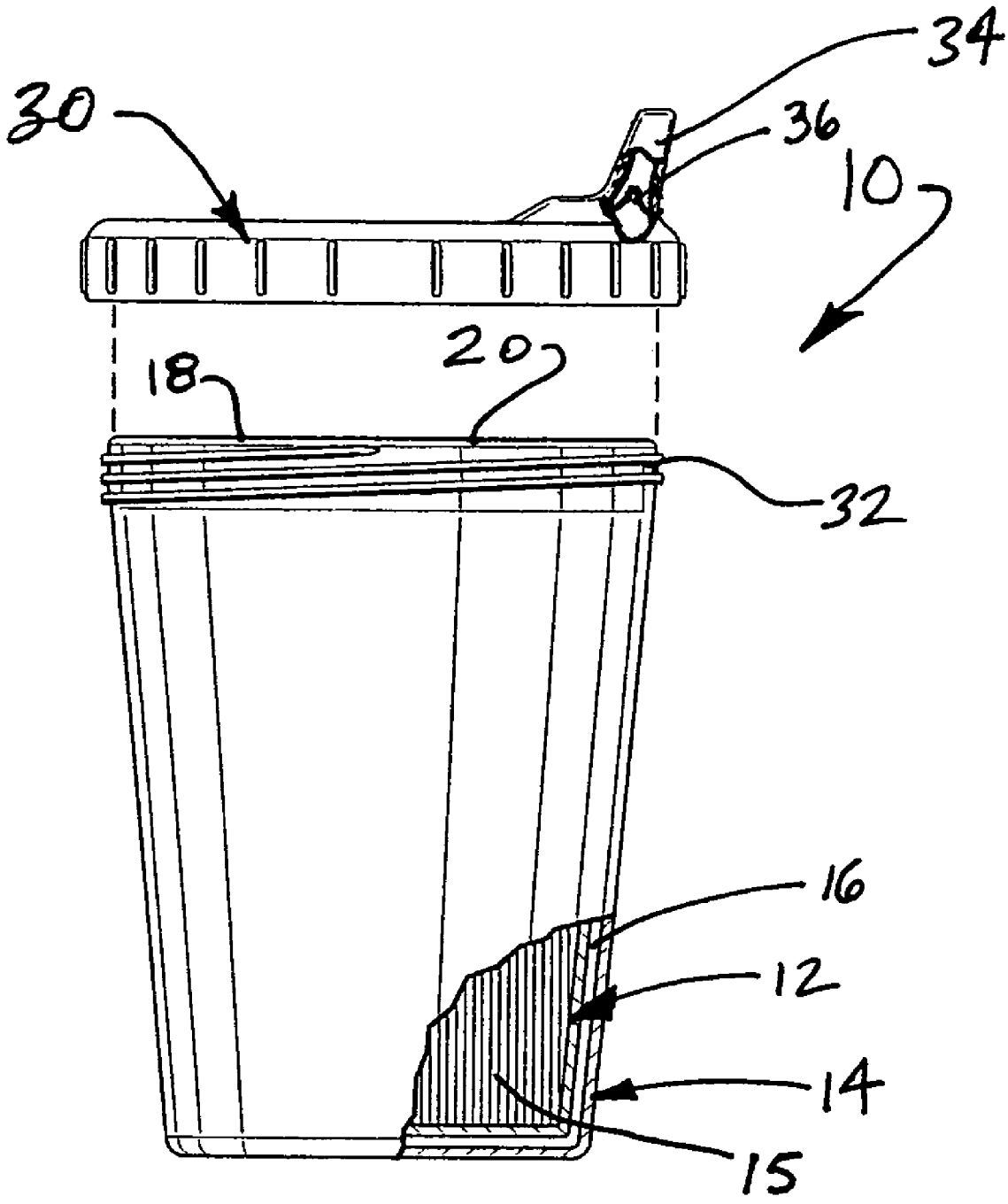
FIG. 4 is an elevational view, in partial cross-section, showing a double wall insulated child's sip cup with a removable top lid having an integrated sip spout extending upwardly therefrom in accordance with a preferred embodiment of the present invention.

A preferred embodiment of the present invention is shown in FIG. 4. Specifically, FIG. 4 illustrates a child's sip cup having an insulated double wall structure, including an inner wall 12, an outer wall 14 and an insulating void 16 between the walls 12, 14. Screw threads 32 formed on the outer surface of the cup, just below the top rim 18, enable screw attachment of the top lid 30, to cover the top opening of the sip cup. The top lid 30 is formed to include an integrated sip spout 34. The sip spout 34 extends upwardly from a remainder of the lid 30 to facilitate ease of placement of the sip spout 34 within a child's mouth in a manner which allows the child's lips to be sealed around the sides of the sip spout 34 when consuming the beverage contents. A valve 36 is provided on the lid 30, in fluid communication with the sip spout 34 to prevent inadvertent discharge and spills of the beverage contents through the sip spout 34 in the event the sip cup is inverted or tipped on its side. Much like the embodiment described in connection with FIGS. 1–3, the sip cup may be provided with a light absorbing luminescent material to enhance the appearance and visibility of the sip cup, as well as the liquid contents therein, when in a dark or dim light environment. Preferably, the light absorbing luminescent material is applied to the insulating double wall structure, within the void, such as on the outer surface of the inner wall.

While the present invention has been shown and described in accordance with several preferred and practical embodiments thereof, it is recognized that departures from the instant disclosure are contemplated within the spirit and scope of the present invention which, therefore, should not be limited except as set forth in the following claims as interpreted under the doctrine of equivalents.

What is claimed is:

1. A child's sip cup for containing a liquid beverage to be consumed therefrom, said child's sip cup comprising:

an insulated wall structure forming a bottom and side walls and terminating at a top rim surrounding an open top of said child's sip cup;

said insulated wall structure comprising:

an inner wall formed of a transparent material;

an outer wall formed of a transparent material and spaced from said inner wall to provide a void between said inner and outer walls, and said void surrounding said inner wall;

a luminescent material applied to said inner wall for illuminating the child's sip cup in dark and dim light conditions; and a lid removably attachable to said insulated wall structure to cover said open top, and said lid including an integrated sip spout extending upwardly above a remainder of said lid and being structured and disposed for placement of a child's lips thereabout, and a spill resistant valve in fluid communication with said sip spout for discouraging accidental discharge of the liquid contents from the sip spout.

2. The child's sip cup as recited in claim 1 further comprising:

cooperating screw threads on said insulated wall structure and said lid for screw attachment of said lid to said insulated wall structure.

3. A child's sip cup for containing a liquid beverage to be consumed therefrom, said child's sip cup comprising:

an insulated wall structure terminating at a top rim surrounding an open top;

said insulated wall structure comprising:

an inner wall formed of a transparent material;

an outer wall formed of a transparent material and spaced from said inner wall to provide a void between said inner and outer walls;

a luminescent material applied to said inner wall for illuminating the child's sip cup in dark and dim light conditions; and a lid removably attachable to said insulated wall structure to cover said open top, and said lid including a sip spout extending upwardly above a remainder of said lid and being structured and disposed for placement of a child's lips thereabout, and a spill resistant valve in fluid communication with said sip spout for discouraging accidental discharge of the liquid contents from said sip spout.

4. A child's sip cup as recited in claim 3 further comprising:

cooperating screw threads on said insulated wall structure and said lid for screw attachment of said lid to said insulated wall structure.

5. A child's sip cup for containing a liquid beverage to be consumed therefrom, said child's sip cup comprising:

an insulated wall structure terminating at a top rim surrounding an open top;

said insulated wall structure comprising:

an inner wall formed of a transparent material;

an outer wall formed of a transparent material and spaced from said inner wall to provide a void between said inner and outer walls;

a luminescent material applied to said inner wall for illuminating the child's sip cup in dark and dim light conditions; and a lid removably attachable to said insulated wall structure to cover said open top, and said lid including a sip spout extending upwardly above a remainder of said lid and being structured and disposed for placement of a child's lips thereabout, and a spill resistant valve below said sip spout and in fluid communication with said sip spout for discouraging accidental discharge of the liquid contents from said sip spout.

6. The child's sip cup as recited in claim 5 further comprising:

cooperating screw threads on said insulated wall structure and said lid for screw attachment of said lid to said insulated wall structure.

* * * * *